United States Patent [19]

Siewert

[11] 4,316,705

[45] Feb. 23, 1982

[54] HOUSING ASSEMBLY FOR SPLIT CRANKCASE RADIAL COMPRESSOR

[75] Inventor: Herbert G. Siewert, Sylvania, Ohio

[73] Assignee: Tecumseh Products Company, Tecumseh, Mich.

[21] Appl. No.: 98,910

[22] Filed: Nov. 30, 1979

[51] Int. Cl.[3] ..... F16J 10/02; F04B 1/04

[52] U.S. Cl. ..... 417/273; 92/171

[58] Field of Search ..... 92/169, 170, 171; 417/269, 273

[56] References Cited

U.S. PATENT DOCUMENTS

| | | | |
|---|---|---|---|
| 1,820,883 | 8/1931 | Hueber | 417/273 |
| 2,319,718 | 5/1943 | Brooks | 417/273 |
| 2,586,537 | 2/1952 | Hapman | 92/170 |
| 3,246,581 | 4/1966 | Carr | 92/169 |
| 3,431,865 | 3/1969 | Cook et al. | 417/273 |
| 3,685,923 | 11/1970 | Hutchins | 417/273 |
| 3,838,942 | 10/1974 | Pokorny | 417/269 |
| 3,910,164 | 10/1975 | Swadner et al. | 417/273 |
| 3,924,968 | 12/1975 | Gaines | 417/273 |
| 4,050,852 | 9/1977 | Brucken | 417/273 |

FOREIGN PATENT DOCUMENTS

| | | | |
|---|---|---|---|
| 1096750 | 1/1961 | Fed. Rep. of Germany | 417/273 |
| 2415884 | 10/1975 | Fed. Rep. of Germany | 417/273 |
| 858595 | 1/1961 | United Kingdom . | |
| 876602 | 9/1961 | United Kingdom . | |
| 1565799 | 4/1980 | United Kingdom . | |

*Primary Examiner*—William L. Freeh

*Attorney, Agent, or Firm*—Albert L. Jeffers; John F. Hoffman

[57] ABSTRACT

A housing assembly for a scotch yoke radial compressor especially adapted for use in automotive air-conditioners having a cast crankcase which is split along a plane axially passing through the center lines of the radially oriented cylinders. Each half of the crankcase has a plurality of radially extending semi-cylindrical recesses which, when assembled, form the cylinders. A steel outer housing encloses the crankcase and serves to form the intake and outlet chambers. The housing is formed of two halves which are joined together along a fluid-tight interface and additionally strengthened by means of a plurality of tie rods which pass through openings in the crankcase and clamp the housing halves tightly together. The tie rods pass through eyelet rivets disposed within the openings in the crankcase. The rivets are clinched so as to secure the crankcase halves together and seal the interface between the crankcase halves in the area of the tie rod openings. The eyelet rivets also serve to provide a guide for the tie rods during assembly for ease in mating the two halves of the housing.

14 Claims, 3 Drawing Figures

HOUSING ASSEMBLY FOR SPLIT CRANKCASE RADIAL COMPRESSOR

BACKGROUND OF THE INVENTION

The present invention relates to a split crankcase radial compressor, such as a scotch yoke radial compressor adapted for use in an automotive air-conditioner. Specifically, the invention is related to the external housing assembly and the means for connecting the housing halves together as well as the means for connecting the two halves of the crankcase together.

Automotive air conditioning systems require small, lightweight compressors which can be conveniently mounted to the engine and driven by the same belt system that drives the fan, alternator and power steering pump. One compressor which has been found to meet these requirements is a radial compressor wherein a plurality of pistons are reciprocated within cylinders radially disposed about the crankshaft.

One problem with this type of compressor, however, is the difficulty of assembling the pistons to the crankshaft and crankcase. One prior art approach is to insert the pistons through the cylinders and then press fit them to the yoke assembly. A more satisfactory technique is disclosed in U.S. Pat. No. 3,910,164, which discloses a radial compressor wherein the crankcase is split, with each of the two halves including a plurality of semicylindrical cross recesses. The piston assembly is placed in one of the crankcase halves and then the other half is secured thereto. An improvement to this basic type of compressor is disclosed in copending U.S. patent application Ser. No. 939,877 filed Sept. 5, 1978, now U.S. Pat. No. 4,273,519 which is owned by the assignee herein. The compressor which is the subject of that patent application solves the problem of providing a good seal between the crankcase halves by preassembling the pistons with stamped steel cylinder liners prior to assembly with the crankcase. The liners prevent cylinder leakage through the interface between the crankcase halves and provide the desired compatability for wear against the aluminum pistons.

In the compressor disclosed in the aforementioned application Ser. No. 939,877, an external housing, which is also of a two-piece construction, encloses the crankcase and forms the intake and outlet chambers. A significant problem in the construction of a lightweight automotive compressor incorporating such a housing as the high pressure envelope, is that of obtaining sufficient strength in the housing to withstand safety required burst pressure levels. To rely only on the weld around the interface of the housing halves is often not satisfactory to meet safety standards. In order to solve this problem, the present invention strengthens the flexible ends of this type of housing by incorporating tie rods which are rigidly connected to the housing halves as by welding, riveting, etc.

From the standpoint of good strength and to minimize the overall size of the compressor, it is advantageous to pass the tie rods through openings in the crankcase halves. This creates a secondary problem, however, which is the creation of a possible internal leak path from the high pressure cavity to the low pressure cavity in the area of the openings formed to accommodate the passage of the tie rods.

SUMMARY OF THE INVENTION

The above-discussed problems with the prior split crankcase radial compressors are overcome by the present invention wherein the front and rear covers of the outer housing are secured together by means of tie rods which pass through mating openings in the crankcase halves and are rigidly connected at their opposite ends to the halves of the outer housing, and serve to tightly eclamp the housing halves together. The tie rods pass through tubular rivets within the openings in the crankcase halves, and the rivets are clinched so as to rigidly secure the crankcase halves together and seal the interface between the crankcase halves in the area of the openings. The tubular rivets also serve as a guide for the tie rods during assembly for ease in mating the front housing and tie rods to the rear housing.

Specifically, the present invention contemplates a housing assembly for use in a radial compressor of the type including a crankcase having a plurality of radially oriented cylinders therein, a crankshaft assembly received in the crankcase and positioned centrally of the cylinders, and pistons connected to the crankshaft assembly and received in the cylinders for reciprocating movement. The crankcase is of the split-type comprising two halves joined together at an interface axially intersecting the cylinders. The housing for the crankcase also comprises two halves mated together along a fluid-tight interface, and the improvement comprises a plurality of tie rods extending through the crankcase and being connected to the housing halves at their opposite ends, the tie rods clamping the housing halves tightly together. The openings in the crankcase through which the tie rods extend are sealed by means of tubular sleeves, which also serve to connect the crankcase halves together.

In a preferred embodiment of the invention, the tie rods are welded to the inner surface of one of the housing halves, extend through openings in the other half of the housing and are welded to the outer surface thereof. The sleeves are preferably tubular eyelet rivets which are clinched against the front and rear surfaces of the crankcase halves so as to seal the tie rod openings and rigidly connect the crankcase halves together.

The above-described structure strengthens the flexible pressure cavity and the lower pressure cavity are sealed. Furthermore, assembly of the compressor, which is the primary reason for forming the crankcase of two halves split along the axes of the cylinders, is facilitated by utilizing the tubular rivets as guides for the tie rods.

DETAILED DESCRIPTION

Figure 1:
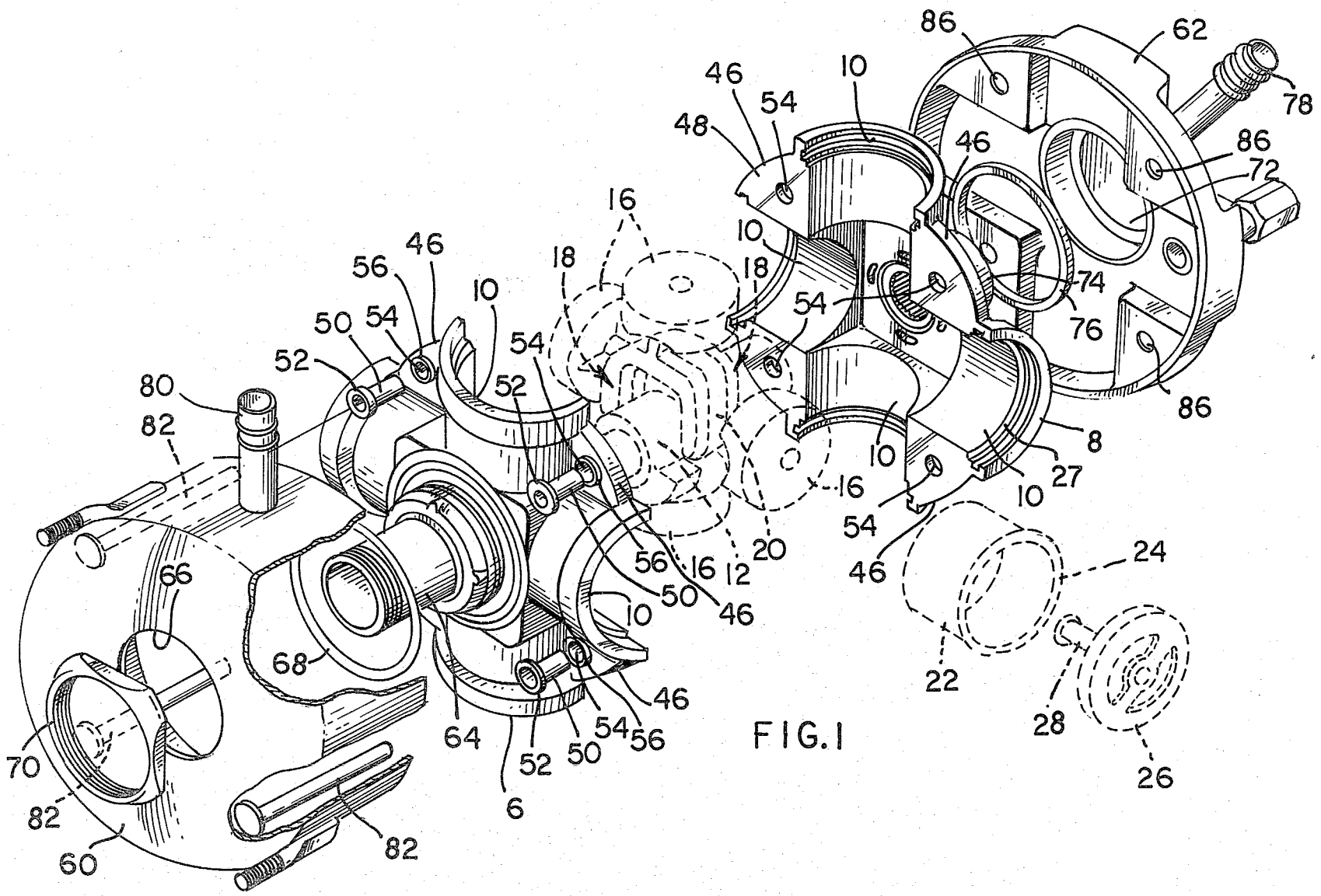
FIG. 1 is an exploded perspective view of a portion of a scotch yoke radial compressor incorporating the housing and crankcase assembly according to the present invention.

Referring now in detail to the drawings, the compressor according to the present invention comprises a pair of cast aluminum crankcase halves or sections 6 and 8 with each of the sections 6 and 8 including semicylindrical recesses 10 therein. The semicylindrical recesses 10 are positioned with their axes running perpendicular to the axis of the crankshaft 12, and when the two crankcase sections 6 and 8 are assembled, the recesses 10 form the cylinders 14 within which the pistons 16 are received.

The pistons 16 are part of a pair of integral, double-ended piston yoke elements 18. Pistons 16 are inserted within respective stamped steel cylinder liners 22, which are generally cylindrical in shape and include short flanges 24 on their distal ends. Also shown in FIG. 1 is one of the four valve plates 26 adapted to be seated on shoulders 24 in cylinder liners 22, and one of the discharge rivets 28. Due to the fact that the present invention is concerned with the crankcase and housing assembly, only the general outline of the compressor moving parts assembly is illustrated in FIG. 1.

Figure 2:
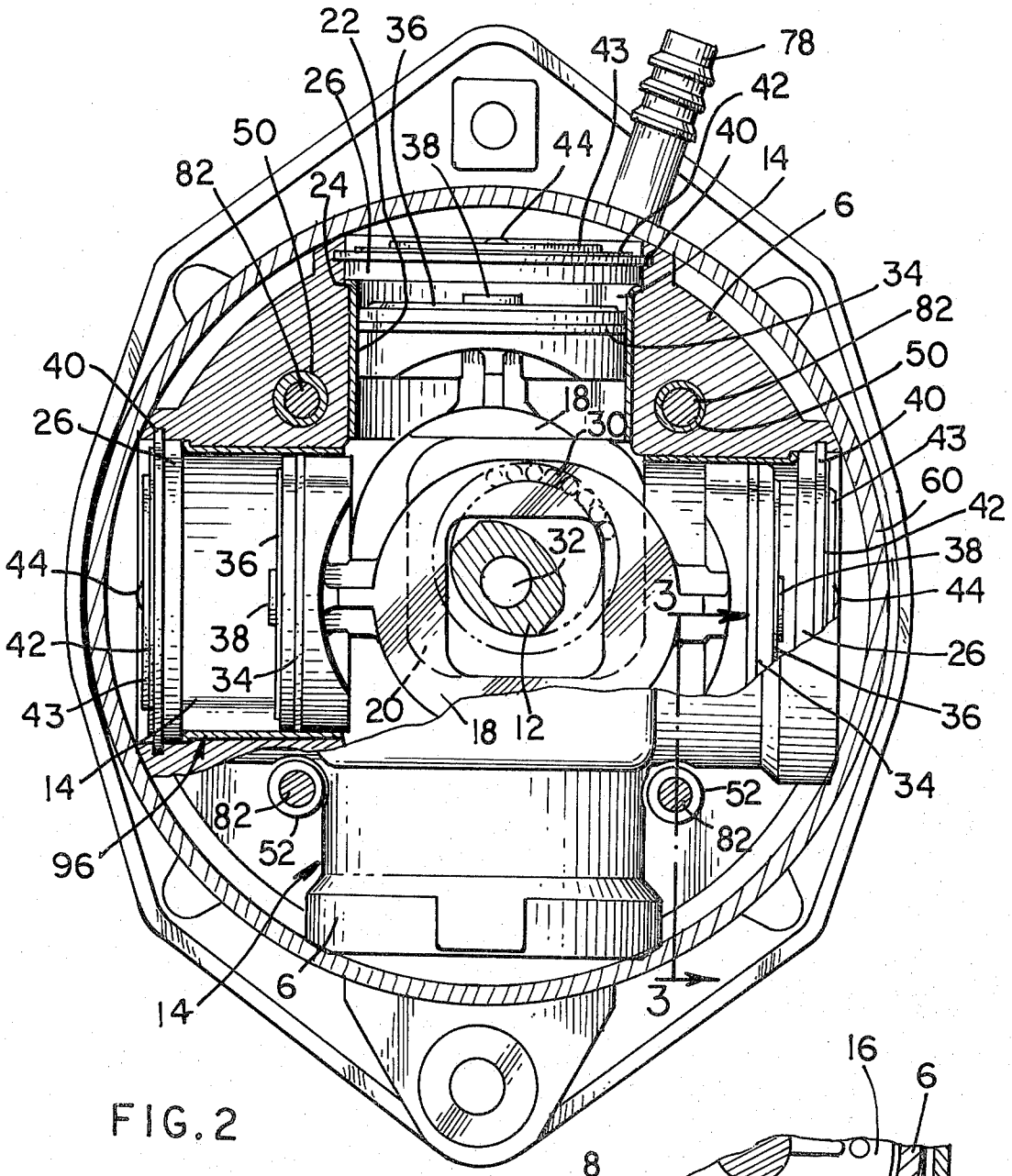
FIG. 2 is a sectional view of the compressor as viewed along the axis of the crankshaft.

With reference to FIG. 2, additional details of the compressor structure will be seen. Crankshaft 12 is rotatably received within bearing 30 and will be seen to include a lubricant passageway 32. Piston rings 34 are snap fit within grooves in pistons 16, and suction leaf valves 36 are connected to pistons 16 by means of rivets 38.

Snap rings 40 retain valve plates 26 in place, and discharge leaf valves 42 are connected to valve plates 26 by valve retainers 43 and rivets 44. Cylinder liners 22 are held in place by means of their flanges 24 being clamped between shoulders on crankcase halves 6 and 8 and valve plates 26.

Figure 3:
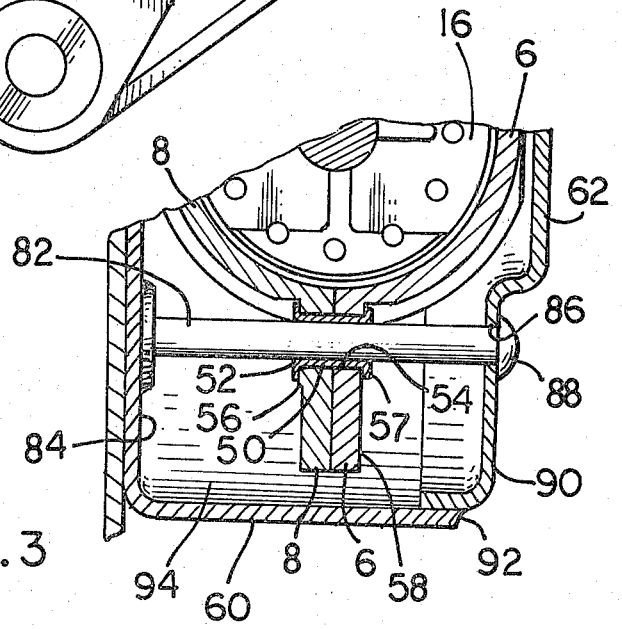
FIG. 3 is a fragmentary sectional view along line 3—3 of FIG. 2 showing the tie rod and tubular rivet assembly.

Each of the crankcase sections 6 and 8 includes web portions 46 having flat mating surfaces 48 wich are in face-to-face abutment when the crankcase sections 6 and 8 are assembled. In order to ensure that there is no leakage between the high pressure chamber and lower pressure chamber, it is necessary that the facing surfaces 48 of web portions 46 make uniform, parallel contact. Crankcase sections 6 and 8 are connected together by means of tubular eyelet rivets 50, each of which includes an enlarged head portion 52. Each of the rivets extends through the openings 54 in crankcase sections 6 and 8 which are in alignment when the sections 6 and 8 are assembled, with the enlarged head portions 52 abutting raised areas 56 on the web portions of crankcase section 6. The distal ends 57 of tubular rivets 50 are clinched so as to spread them out against the outer surface 58 of crankcase section 8 forming flange-like portions as illustrated in FIG. 3, such that the crankcase sections 6 and 8 are tightly secured together. Tubular rivets 50 also serve to seal the interface between the crankcase sections 6 and 8 in the area of openings 54 so that leakage between the high pressure and low pressure chambers is prevented.

The assembled crankcase is enclosed by a housing assembly comprising a front cover 60 and a rear cover 62, each of which is of stamped steel construction. The front cover 60 is somewhat larger than the rear cover 62 and abuts against the front face of crankcase section 6 with the tubular, crankshaft bearing portion 64 extending through an opening 66 in front cover 60. O-ring 68 seals the interface between front housing section 60 and crankcase section 6 in the area of opening 66, and nut 70 holds the crankcase front housing section assembly together.

The rear housing section 62 abuts against crankcase section 8 and includes an axial intake chamber 72 which fits around the rearwardly facing tubular portion 74 of rear crankcase section 8. O-ring 76, which is compressed between rear housing section 62 and the rear surface of crankcase section 8, serves to seal the intake chamber 72 from the discharge chamber 94, the latter being formed between housing 60, 62 and crankcase 6, 8. Intake tube 78 communicates with the interior of chamber 72, and discharge tube 80 communicates with the interior of housing 60, 62.

The housing halves 60 and 62 are held together by means of four steel tie rods 82, which are welded to the inner surface 84 of housing front section 60, extend through tubular rivets 50, and also extend through openings 86 in rear housing section 62 (FIG. 3). With the housing section 60 and 62 being held tightly together, welds 88 between tie rods 82 and the outer surface 90 of rear housing section 62 retain the assembly in place. Front and rear housing sections 60 and 62 are also welded together at 92 around the entire perimeter of their mutual interface. Although tie rods 82 have been shown as being welded in place, other fastening techniques, such as riveting, securing by means of nuts, etc. may be utilized as long as the interior of housing 60, 62 remains sealed. With the compressor assembled, high pressure discharge chamber 94 is formed between housing 60, 62 and crankcase 6, 8, with the intake chamber 72 being sealed therefrom by means of O-ring 76. Tubular rivets 50, because they line openings 54 and are sealingly clinched tightly against crankcase halves 6 and 8, prevent leakage between the aforementioned high pressure and low pressure chambers 94 and 72 around openings 54.

When assembling the compressor, the piston-yoke elements 18 are preassembled with their rings 34 to cylinder liners 22, and this assembly is installed on the crankshaft. Then slide 20 is installed as a unit into crankcase section 6 followed by the second yoke/cylinder liner subassembly. The other half 8 of the crankcase is then placed over this assembly, tubular rivets 50 are inserted within openings 54 and their distal ends clinched against crankcase section 6 so as to hold the crankcase sections 6 and 8 tightly together, and the valve assemblies are installed.

The tie rods 82 are welded to the inner surface 84 of housing section 60, and the assembled crankcase including O-ring 68 is inserted within housing section 60 over tie rods 82, which are guided by means of tubular rivets 50. Nut 70 is then installed, which serves to retain the assembly in housing 60 and capture O-ring 68. After emplacing O-ring 76, the rear housing section 62 is placed over the assembled crankcase assembly and is inserted within front housing section 60 such that tie rods 82 extend through openings 86 (FIG. 3). The ends of tie rods 82 are then welded to the outer surface 90 of rear housing section 62, and the interface between housing sections 60 and 62 is sealed by means of weld 92.

In operation, as crankshaft 12 is rotated by means of a belt-pulley assembly (not shown), slide block 20 will cause pistons 16 to reciprocate within their respective cylinders 14 so as to draw gas into the cylinders 14 from intake chamber 72 and discharge the compressed gas into the discharge chamber 94. Incoming gas is brought into intake chamber 72 through intake tube 78, and the high pressure discharge gas is delivered to the refrigeration system condenser (not shown) through discharge tube 80.

While this invention has been described as having a preferred design, it will be understood that it is capable of further modification. This application is, therefore, intended to cover any variations, uses, or adaptations of the invention following the general principles thereof and including such departures from the present disclosure as come within known or customary practice in the art to which this invention pertains and fall within the limits of the appended claims.

What is claimed is:

1. In a radial compressor of the type including a crankcase having a plurality of radially oriented cylinders therein, crankshaft means received in said crankcase and positioned centrally of said cylinders, and pistons connected to said crankshaft and received in said cylinders for reciprocating movement, said crankcase being of the split-type comprising two halves joined together at an interface axially intersecting said cylinders, and a housing enclosing said crankcase, said housing comprising two halves mated together along a fluid-tight interface, the improvement comprising a plurality of tie rod means extending within said housing and being connected to said housing halves, said tie rod means clamping said housing halves together.

2. The compressor of claim 1 wherein said tie rod means each comprises a metallic rod-like member having one end extending through an opening in one of said housing halves, and wherein said one end is welded to said one of said housing halves so as to tightly connect said housing halves together.

3. The compressor of claim 2 wherein the other end of each of said rod-like members is welded to the other of the housing halves.

4. The compressor of claim 1 including: a plurality of openings in said crankcase through which said tie rod means pass, and eyelet rivets in each of said openings riveting said crankcase halves together, said rivets sealing the interface of said crankcase halves around said openings and serving as sleeves for said tie rod means.

5. The compressor of claim 4 wherein said eyelet rivets serve as the sole means for connecting said crankcase halves together.

6. In a radial compressor of the type including a crankcase having a plurality of radially oriented cylinders therein, crankshaft means rotatably received in said crankcase and positioned centrally of said cylinders, and pistons connected to said crankshaft and received in said cylinders for reciprocating movement, said crankcase being of the split-type comprising two halves mated together at a fluid-tight interface, and a housing enclosing said crankcase, said housing comprising two halves mated together along a fluid-tight interface, the improvement comprising: a plurality of openings in each of said crankcase halves, the respective openings in each crankcase half mating with each other, sleeve means in each pair of mating openings serving to tightly connect said crankcase halves together, a plurality of tie rod means extending through the respective sleeves and being connected to said housing halves, said tie rod means clamping said housing halves together.

7. The compressor of claim 6 wherein said sleeves serve to seal the interface between said crankcase halves around said openings.

8. The compressor of claim 7 wherein said sleeves are eyelet rivets and function as the sole means for connecting said crankcase halves together.

9. The compressor of claim 6 wherein said tie rod means each comprises a metallic rod-like member having one end extending through an opening in one of said housing halves, and wherein said one end is welded to said one of said housing halves so as to tightly connect said housing halves together.

10. The compressor of claim 9 wherein said housing halves are welded to each other along their interface.

11. A compressor comprising: a crankcase, a housing enclosing said crankcase and defining a discharge chamber between the housing and crankcase, means within said crankcase for compressing a fluid and discharging the compressed fluid into the discharge chamber, said housing comprising a first section and a separate second section mating with said first section along a fluid-tight interface, and a plurality of tie rod means each connected at one end to one of said housing sections and connected at the other end to the other housing section so as to rigidly connect said housing sections together, said tie rods extending through said discharge chamber.

12. The compressor of claim 11 wherein said tie rods pass through openings in said crankcase.

13. The compressor of claim 11 wherein said tie rods are attached to an inner surface of one of said housing sections and pass through external openings in the other of said housing sections, and including means for sealing said openings around the tie rods passing therethrough so as to maintain the housing fluid-tight.

14. The compressor of claim 13 wherein said tie rods are welded to said housing sections.

* * * * *